US005662555A

United States Patent [19]

Cloutier

[11] Patent Number: 5,662,555

[45] Date of Patent: Sep. 2, 1997

[54] AERIAL EXERCISE SYSTEM AND METHOD OF USING THE SAME

[76] Inventor: Normand P. Cloutier, 69 Depot Rd., Auburn, N.H. 03032

[21] Appl. No.: 556,296

[22] Filed: Oct. 24, 1995

[51] Int. Cl.[6] ..... A63B 26/00

[52] U.S. Cl. ..... 482/23; 402/24; 402/43; 402/143; 402/908

[58] Field of Search ..... 482/33, 43, 96, 482/143, 144, 907, 908, 904, 23–40, 131, 139, 148; 473/247; 472/120, 124, 125

[56] References Cited

U.S. PATENT DOCUMENTS

| | | | |
|---|---|---|---|
| 324,513 | 8/1885 | Albrecht | 482/24 |
| 431,206 | 7/1890 | Gloy | 482/24 |
| 1,003,193 | 9/1911 | McDermott | 482/24 |
| 1,012,212 | 12/1911 | Mells | 482/24 |
| 2,222,119 | 11/1940 | Overholt | 482/24 |
| 3,226,115 | 12/1965 | Underhill | 482/24 |
| 3,521,848 | 7/1970 | Aase | 482/24 |
| 3,593,708 | 7/1971 | Steele | 482/24 |
| 4,492,373 | 1/1985 | Dzitzer | 482/143 |
| 4,690,133 | 9/1987 | George | 482/144 |
| 4,921,245 | 5/1990 | Roberts | 482/23 |
| 5,067,706 | 11/1991 | Tsai | 482/36 |
| 5,178,590 | 1/1993 | Stephens | 482/23 |

FOREIGN PATENT DOCUMENTS

| | | | |
|---|---|---|---|
| 2063468 | 12/1977 | Germany | 482/122 |
| 597876 | 4/1978 | Switzerland | 482/24 |
| 1025436 | 6/1983 | U.S.S.R. | 482/43 |

*Primary Examiner*—Jeannie M. Clark
*Attorney, Agent, or Firm*—Davis and Bujold

[57] ABSTRACT

A family, portable power stretching and entire body building gym, and method of using the same, comprising hooks (2) for suspending the device from a rod or beam (4), first elongate flexible members (8) secured at a first end thereof to the hooks (2), stirrups (10) secured at a second end of the first elongate flexible members (8), second elongate flexible members (12) secured at one end to the hooks (2), a plurality of connectors (14) spaced along the second elongate flexible members (12), and hand grips (16) removable attached to the connectors (14). The gym also comprises a chin bar, slant board and knee bar inverted posture devices for being adjustably suspended from the elongate flexible members for working and stretching the entire body in an inverted position, enabling gravity to help relieve spine compression created from being in an upright position.

17 Claims, 3 Drawing Sheets

AERIAL EXERCISE SYSTEM AND METHOD OF USING THE SAME

FIELD OF THE INVENTION

This invention relates to power stretching and body building exercise equipment, and more particularly, to a portable exercise device Comprising stirrups and rings, and, if desired, a chin bar, slant board and knee bar inverted posture device suspended on ropes or chains for working and stretching the entire body.

BACKGROUND OF THE INVENTION

It is known in the art to use exercise equipment for stretching, exercising, and strengthening different parts of the human body. This equipment, for example, dead weights and large expensive machines, is often bulky, difficult to move and expensive.

Exercise equipment presently known in the art also typically only allows the user to work on a limited portion of the body, such as the biceps, or the wrists, or the legs.

SUMMARY OF THE INVENTION

Wherefore, it is an object of the present invention to overcome the aforementioned problems and drawbacks associated with the prior art designs.

Another object of the invention is to provide an exercise device which allows an individual to be suspended from hand grips and stirrups in order to stretch and build and strengthen their entire body.

A further object of the invention is to provide body weights to be worn by an individual, leaving their hands free to grasp the grips and stirrups to further stretch, build and strengthen their entire body.

A further object of the invention is to provide an exercise device that allows an individual to be suspended upside down from one of four inverted posture devices, a chin bar, a safety belt, knee bars and a slant board, in order to stretch and do exercises while in an inverted position and thereby enable gravity to help relieve spine compression created from being in an upright position when performing conventional exercises, such as weight lifting and jogging.

Yet another object of the invention is to provide an exercise device that is portable and allows the user to disassemble, transport, and assemble the device easily.

Still another object of the invention is to provide an exercise device that will allow the user to strengthen many different muscles in the body simultaneously.

The present invention relates to an exercise device comprising two hook members, support rings secured to the hook members, a first rope secured at a first end thereof to the support rings, stirrups secured to a second end of the first ropes, second ropes secured at a first end thereof to the support rings, a plurality of connectors spaced along the second ropes, and hand grips removably attached to one of the plurality of connectors.

The present invention also relates to a method of using an exercise device comprising the steps of: providing two hook members, securing support rings to each of the hook members, securing first ropes at a first end thereof to each of the support rings, securing stirrups to a second end of each of the first ropes, securing second ropes at a first end thereof to each of the support rings, securing a plurality of connectors spaced along each of the second ropes, removably attaching hand grips to each of the second ropes via one of the plurality of connectors, suspending the hook members from a fixed structure, grasping the hand grips with one's hands, placing one's feet in the stirrups, and performing exercises.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
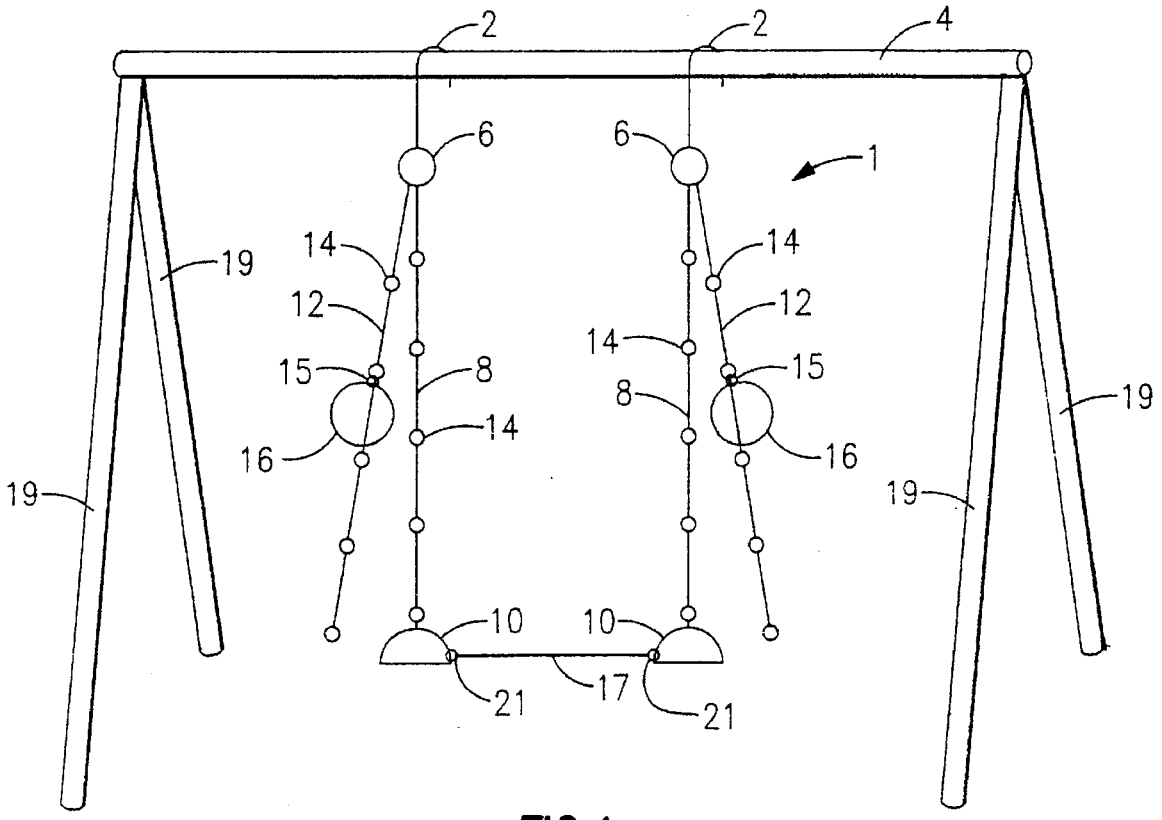
FIG. 1 is a diagrammatic perspective view of an exercise device according to a first embodiment of the invention.

Turning now to FIG. 1, a detailed description concerning the present invention will now be provided. The exercise device, generally designated by reference numeral 1, comprises hooks 2, formed of a J shape, which are provided for suspending exercise device 1 from a rod 4. It is to be appreciated that rod 4 can be any member from which hooks 2 can suspend exercise device 1, e.g. eye bolts, hooks, lumber, ladder rungs, straps, belts, bolts, screws, etc.

It is important that hooks 2 are restricted from moving along the length of rod 4 while the exercise device 1 is in use. Such movement can be prevented, for example, on rod 4 by notches or grooves in rod 4, in which hooks 2 rest. This movement can also be prevented by friction when rod 4 is made of a first material, such as wood or a resilient plastic, and hooks 2 are made of a second material, such as metal, such that hooks 2 bite into rod 4 to a certain extent upon application of weight upon hooks 2.

Hooks 2 are provided with support rings 6 at the straight end of their J shape. Ropes 8 are secured at a first end thereof to support rings 6, and stirrups 10 are secured to ropes 8 at a second end thereof.

Elongate flexible members such as ropes 12 are attached at a first end thereof to support rings 6. Connectors 14 are secured to ropes 8 and 12 and are spaced along the length of ropes 8 and 12. It is to be appreciated that ropes 8 and 12 may be comprised of lengths of rope with a first length secured at a first end thereof to support ring 6, and a second end thereof secured to connector 14, with the remainder of the lengths of rope secured to connectors 14 such that they form one continuous length of rope. Alternatively the elongate flexible members 8 and 12 may be, for example, chains.

Connectors 14 are preferably spaced at intervals of 3 to 6 inches along ropes 8 and 12, although it can be appreciated that any desired spacing may be employed.

It is to be appreciated that ropes 8, 12 need not be any particular length, but may be shorter than the distance from where they are secured to support rings 16 to the surface, e.g. floor or ground, above which the exercise device 1 is suspended. Stirrups 10, in a preferred embodiment, are suspended 6 inches above the surface above which the exercise device 1 is suspended.

It is also to be appreciated that ropes 8, 12 need not be ropes, and can be chains, belts, straps or any other member of a material such as nylon, plastic, metal, or any other material. The ropes 8, 12 or other member must, however be sufficiently flexible and strong to support the weight of an individual and allow them to move their body while suspended in exercise device 1.

Hooks 15 are secured to hand grips 16, and hand grips 16 are attached to connectors 14 via hooks 15, such that hand grips 16 can easily be moved from one connector 14 to another. Hooks 15 are preferably self closing hooks in order to insure that hand grips 16 do not inadvertently come free from connectors 14. It can be appreciated that hooks 2 may also be self closing.

It is to be appreciated that hand grips 16 and stirrups 10 may be formed of lengths of rope or chain passed through a rigid hollow member and hooked together at both ends via a self closing hook or other conventional means which is in turn attached to a connector 14 along ropes 8 and/or 12.

In use, an individual positions hooks 2 along rod 4, a desired distance apart. This distance is dependent on both the size of the individual and the types of exercises the individual will be performing, as well as the experience level of the individual.

The farther apart hooks 2 are positioned from one another, the harder it is for an individual to maintain their balance, support their weight, and perform exercises. This increase in difficulty will result in a corresponding increase in strength, flexibility, and balance of the individual.

The individual next attaches hand grips 16 at a desired position along ropes 12 by securing hooks 15 to connectors 14. The desired position of the hand grips 16 along ropes 12 is also dependent on the size of the individual and the types of exercises to be performed, as well as the experience level of the individual.

The higher the hand grips 16 are attached along ropes 12, the easier it is for the individual to maintain their balance, support their weight, and perform exercises. A novice user of exercise device 1 might, therefore, position hand grips 16 at a higher position on ropes 12 than a more experienced user.

By varying the distance between hooks 2 on rod 4, and the point along ropes 12 at which hand grips 16 are attached, an individual can easily adjust exercise device 1 to fit their particular exercise needs. This adjustment allows exercise device 1 to be used by everyone from small children to large adults.

The user then grasps hand grips 16 with their hands, and places their feet in stirrups 10. A triangle is thus formed by each pair of ropes 8 and 12, with two of the sides of the triangle being made of ropes 8 and 12 and the remaining side being made by the user. The forces acting on the user from the ropes 8 and 12 are directed toward support rings 6 and help to keep the user suspended in the device.

The individual is now ready to exercise many of the muscles in their body. Since the individual is suspended on exercise device 1, they are forced to maintain their balance and hold on tightly. This naturally strengthens many of the muscles in the body.

An individual can do stretches in a multitude of positions on exercise device 1. They can stand in stirrups 10 with the weight of their body resting on the balls of their feet, thereby increasing calf muscle strength and stretching the Achilles tendon. They can also twist their torso back and forth, and simultaneously stretch their torso, arms, and legs.

Another stretching exercise is for the individual to spread their legs and extend their arms in different directions, which increases arm strength, leg strength, and balance.

The individual can also do strength and body building exercises such as pushups by securing hand grips 16 at a low point on ropes 12. The individual can vary the muscle groups which are strengthened by twisting, rotating, and pivoting their arms and legs as they do the pushups and other exercises.

As the individual's feet are constantly in stirrups 10, and their hands are constantly gripping hand grips 16, the individual's balance and grip strength are increased tremendously.

The individual, while suspended in the device, can do full rotation of their joints, and full stretching of all muscles, under the load of their body weight. The individual can also wear a weight belt, or a weight vest, or any other device for carrying additional weight, in order to further strengthen muscle groups and improve balance as they stretch and do exercises.

The individual can transfer the support of their weight from their arms to their legs and vice versa simply by changing their orientation on the device. This allows the individual to work on one muscle group, and then move to another when the first muscle group tires, simply by shifting their weight.

A novice user of exercise device 1, such as a small child, may start to use the device while standing on the floor or ground, rather than placing their feet in stirrups 10. This will allow the novice to exercise different muscle groups in their body without the added difficulty of maintaining their balance while suspended in stirrups 10, preventing possible injury. As the novice user becomes more proficient and stronger, they can start to use the device with their feet in stirrups 10.

Safety cord 17 is preferably a resilient cord having hooks 21 at its ends which are secured to stirrups 10. Hooks 21 are preferably self closing hooks to prevent safety cord 17 from inadvertently coming free from stirrups 10.

A novice user of exercise device 1 may use safety cord 17 to prevent their legs from spreading too quickly or too far when suspended in exercise device 1. Safety cord 17 can be of any material which will allow stretching while providing resistance such as a bungee cord.

A more experienced individual can also use exercise device 1 by simply holding hand grips 16 and not using stirrups 10. In this position the individual can do pull-ups; inverted push-ups, where the individual hangs upside down from hand grips 16 and then raises and lowers their body by alternately bending and then extending their arms; an iron cross, where the individual supports their weight solely by the use of their arms when their arms are extended out to the sides holding hand grips 16; dips, where the individual holds hand grips 16 while their arms are fully extended downwardly parallel to the sides of their body towards their feet, then raises and, alternately, lowers their body by bending their arms; or any other stretch or exercise.

Cardiovascular exercises are also possible with the present invention. An individual can simulate cross country skiing by placing hand grips 16 along ropes 12 at approximately the height of their elbows when standing in stirrups 10. The individual then moves their legs forward and back, alternately, while moving their arms alternately forward and back as well, as is done when cross country skiing. The individual can also get cardiovascular exercise when standing in stirrups 10 and holding hand grips 16, by moving their legs outwardly from their body towards their sides, and then back, in a repetitive manner, as is done when doing jumping jacks. Moreover, by placing hand grips 16 at a low position along ropes 12, i.e. approximately at the same level as stirrups 10, the individual may also do squat thrusts by repeatedly extending and retracting their legs.

In a preferred embodiment, pairs of support legs 19 are attached at a first end thereof to each end of rod 4. Each pair of support legs 19 forms an acute angle relative to support rod 4, forming a triangle, with the third side of the triangle being formed by the surface upon which support legs 19 rest, i.e. floor or ground. In this embodiment the exercise device 1 resembles a swing set. This configuration gives stability to exercise device 1.

It is to be appreciated that support legs 19 could be augmented with bracing in order to provide additional support. It is also to be appreciated that support legs 19 need not be in pairs. Support legs 19 could be single legs with guy wires to provide bracing, or could be inverted T shapes. Support legs 19 could be telescopic members or be comprised of sections in order to facilitate portability of exercise device 1. It is important that support legs 19 be of sufficient size and rigidity to support the weight of an individual when they are suspended from and moving on exercise device 1.

Figure 2:
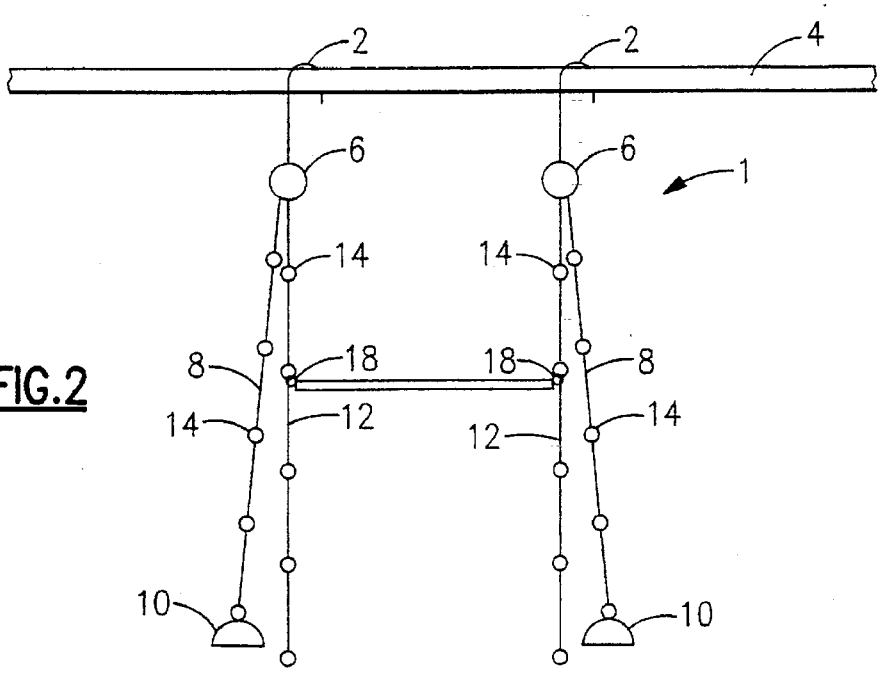
FIG. 2 is a diagrammatic front elevation of an exercise device according to a second embodiment of the invention.

In FIG. 2, a second embodiment of the invention is shown. Hooks 18 are secured to bar 20 at ends thereof. Bar 20 is attached to connectors 14 on ropes 12 via hooks 18. Hooks 18 are preferably self closing hooks in order to insure that bar 20 does not inadvertently come free from connectors 14.

The individual can wrap their legs over bar 20 and hang from their knees. In this position, sit-ups can be performed, and the individual can also to do chin-ups while holding on to bar 20 with their hands.

With this embodiment an individual can do handstands using bar 20 to prevent themselves from tipping over. The individual places their hands on the floor or ground, or in hand grips 16, and lifts their body upwardly with their feet pointing up, away from the floor or ground, in the inverted handstand position. By lightly resting the backs of their legs against bar 20 when in this position they can prevent themselves from falling over.

Bar 20 can be attached to ropes 12 at a low point and provide a member for an individual to stand on as they stretch or perform exercises.

Figure 3:
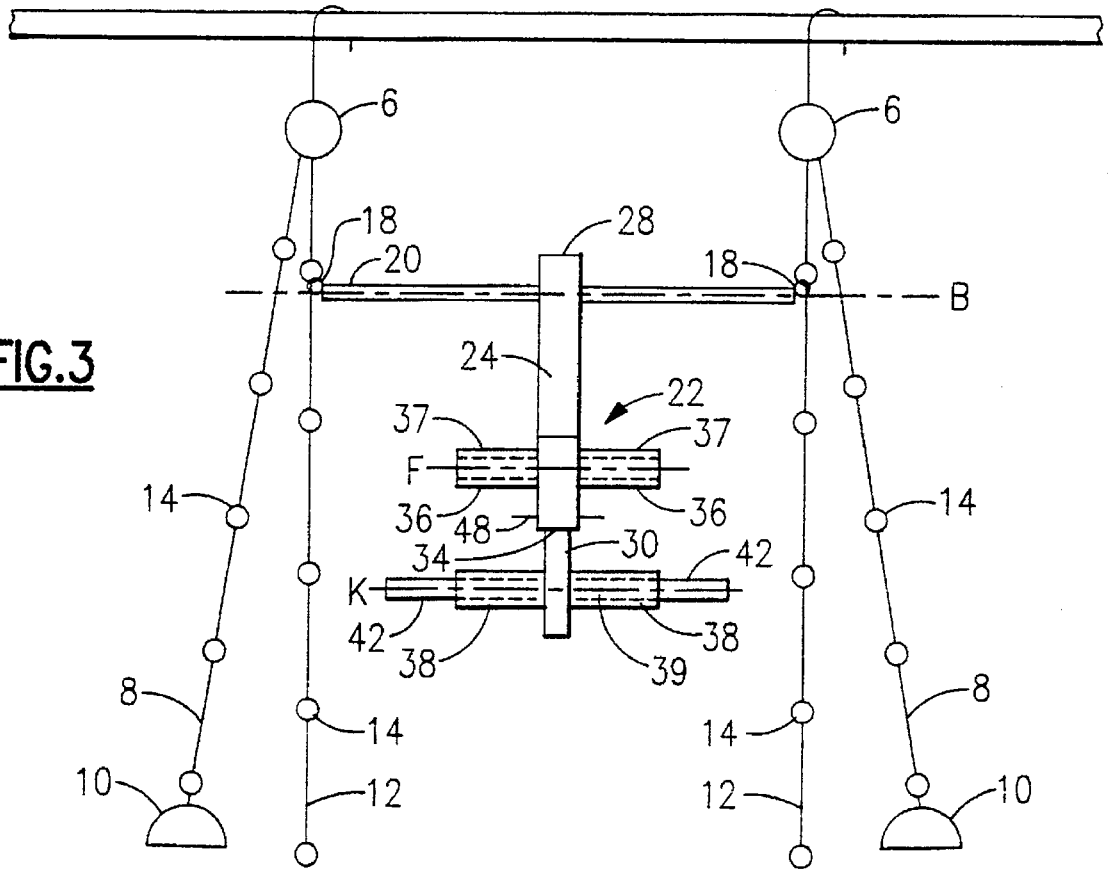
FIG. 3 is a diagrammatic front elevation of an exercise device according to a third embodiment of the invention.
Figure 4:
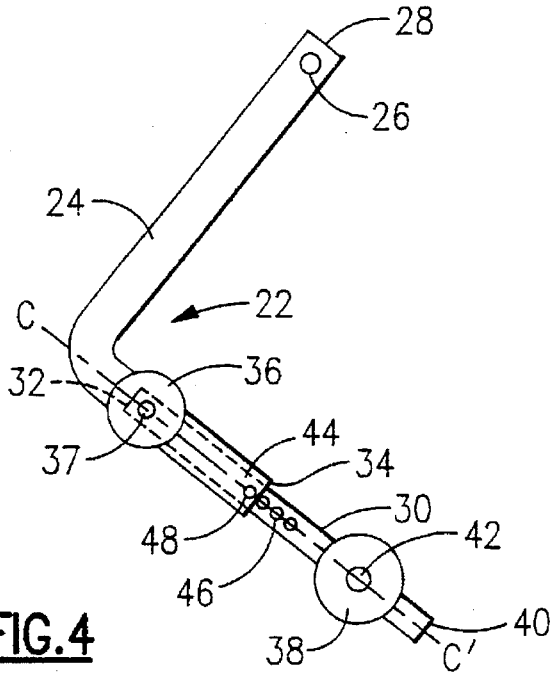
FIG. 4 is a diagrammatic side elevation of the inverted posture member of FIG. 3 of the invention.

A third embodiment of the invention is shown in FIG. 3, with an enlarged view of a portion thereof shown in FIG. 4. Inverted posture member 22 comprises first member 24. First member 24 preferably is an L shaped member with a rectangular cross section, but may have a cylindrical cross section or any other cross section. The lower section of L shaped first member 24 defines a longitudinal axis C.

First member 24 has a through bore 26 adjacent a first end 28. Through bore 26 is sized to accommodate bar 20. Bar 20 is inserted in through bore 26 and then attached to connectors 14 via hooks 18, suspending inverted posture member 22 from exercise device 1. It is to be appreciated that bar 20 may be permanently mounted in through bore 26 or the same bar 20 used in the second embodiment may be removably inserted in through bore 26 as desired.

Second member 30 is an elongate member with a cross section of the same type as first member 24, but a cross section that is slightly smaller than that of first member 24, such that first end 32 of second member 30 can be inserted into second end 34 of first member 24, providing a sliding fit. Second member 30 defines a longitudinal axis C', which is coincident with longitudinal axis C when second member 30 is inserted into first member 24.

Foot members 36 have a generally cylindrical shape ad are secured to first member 24 by cross bars 37 proximate second end 34, cross bars 37 being fast with first member 24, and extend outwardly from opposed sides of first member 24 in opposite directions, such that longitudinal axis F defined by foot members 36 is perpendicular to longitudinal axis C of first member 24 and parallel to longitudinal axis B defined by bar 20.

Knee members 38 have a generally cylindrical shape and are secured to second member 30 by cross bar 39 proximate second end 40, and extend outwardly from opposed sides of second member 30 in opposite directions, such that longitudinal axis K defined by knee members 38 is perpendicular to longitudinal axis C' of second member 30 and parallel to longitudinal axis B of bar 20.

Cross bar 39 extends along longitudinal axis K and beyond knee members 38 to provide a hand bar 42 for an individual to grasp when doing exercises.

First member 24 has a through bore 44 along the lower member of its L shape, adjacent second end 34. Second member 30 has a plurality of through bores 46 adjacent first end 32. Second member 30 is telescopingly inserted into first member 24, through bore 44 is aligned with one of through bores 46, and pin 48 is inserted through aligned through bores 44 and 46.

By removing pin 48, moving second member 30 in either direction along longitudinal axis C', aligning through bore 44 with a desired through bore 46, and inserting pin 48 in the realigned through bores 44 and 46, an individual can adjust the distance between knee members 38 and foot members 36 to comfortably accommodate their body.

It is to be appreciated that the adjustment of foot members 36 relative to knee members 38 need not be performed with the telescoping adjustment of second member 30 within first member 24, but can be accomplished with any device or combination of devices which would allow such an adjustment such as clamps, bolts, screws, springs, fasteners, etc.

Foot members 36 and knee members 38 are preferably made of a soft material such as neoprene or foam rubber.

In use, an individual hooks their knees over knee members 38, hooks their feet under foot members 36, and then hangs upside down from inverted posture member 22. From this position the individual can do sit-ups, or curls, by grasping hand bars 42 with their hands and pulling their body upward.

In this inverted position, the organs of the body are pulled by the force of gravity toward the head of the individual, whereby the organs move towards their "original" position, i.e. their position before the effects of age caused them to drop toward lower areas of the individual's body.

The individual can adjust bar 20 along ropes 12 such that when suspended from inverted posture member 22, th individual can rest the top of their head on the floor or ground. This will allow the individual to stretch their neck muscles by moving their head in different directions, and will allow the individual to stay inverted for a longer time, as part of their weight is supported by their head. Handstands from this inverted position can also allow the individual to stay in this position longer.

Inverted posture member 22 may be used in combination with an adjustable angle table (not shown) to provide a rest position when an individual is hanging from the device.

Figure 5:
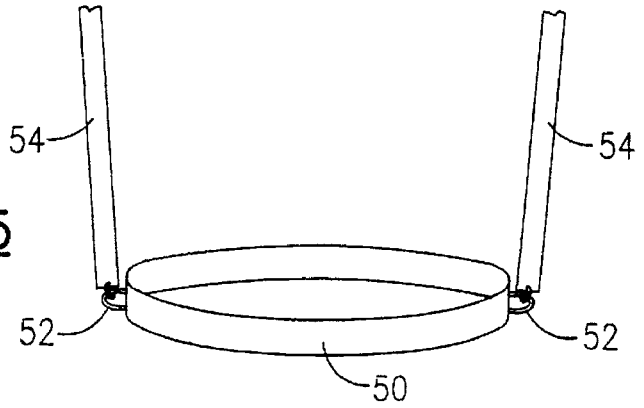
FIG. 5 is a diagrammatic perspective view of a safety belt used in connection with the present invention.

FIG. 5 shows a safety belt 50 with loops 52 on opposed sides of a first surface thereof. Safety straps 54 are attached at one end thereof to loops 52 and to a fixed point such as rod 4 or other structure (not shown) at a second end thereof. Safety belt 50 is to be worn around the waist of an individual while using exercise device 1. Safety straps 54 are resilient and provide sufficient resistance to prevent an individual, who might slip off of stirrups 10 or lose their grip on hand grips 16, from falling quickly to the floor or ground. It can be appreciated that any suitable safety belt or harness may be employed. Safety belt 50 is preferably padded so that an individual may hang from the waist in an inverted position to stretch and exercise their back.

Safety belt 50 can alternatively be attached directly to ropes 8 via hooks such as self closing hooks. This will limit the exercises that an individual may do while suspended in the device since their range of motion will be restricted. This direct attachment will provide an additional margin of safety as it will prevent an individual from falling if they are to lose their balance.

Figure 6:
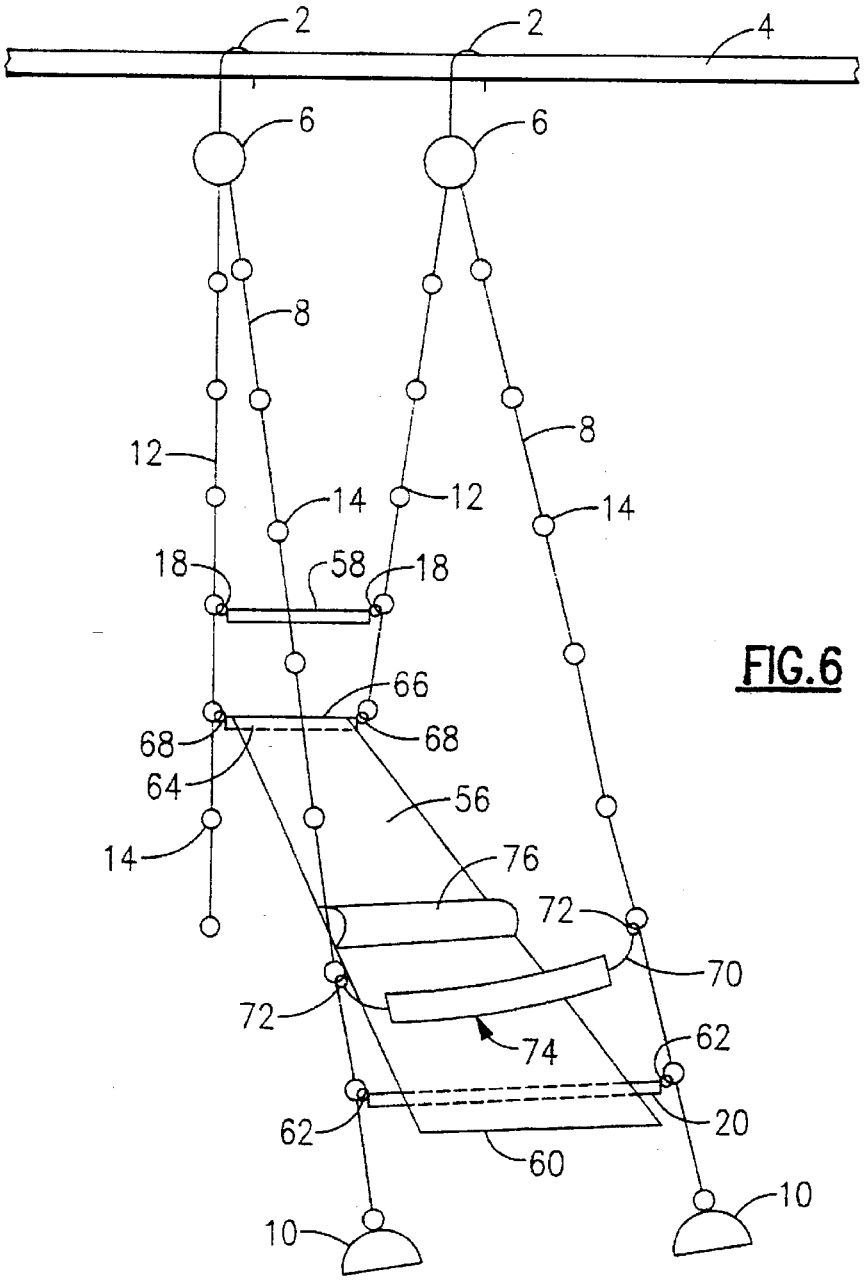
FIG. 6 is a diagrammatic perspective view of an exercise device according to a fourth embodiment of the invention.

A fourth embodiment of the present invention is shown in FIG. 6. Slant board 56 is a rigid board of sufficient length and strength to allow an individual to lie down on the slant board 56 when suspended. Chin bar 20 is secured to a lower surface and proximate a first end 60 of the slant board 56. Bar 20 is parallel to but spaced from first end 60. Hooks 62 on both ends of bar 20 are used to attach bar 20 to ropes 8 via connectors 14, suspending first end 60 of slant board 56.

Bar 64 is secured to a lower surface and proximate a second end 66 of slant board 56 opposite the first end 60. Bar 64 is parallel to but spaced from second end 66 of slant board 56. Hooks 68 on both ends of bar 64 are used to attach bar 64 to ropes 12 via connectors 14, suspending second end 66 of slant board 56. Bar 64 does not extend beyond the sides of slant board 56. An individual can thus use the present invention by lying on their back on suspended slant board 56 and perform stretches and exercises without striking their shins on the ends of bar 64.

Bar 58 is attached to ropes 12 via hooks 18 attached to connectors 14 at a point along ropes 12 higher than first end 66. The individual can hook his/her feet behind bar 58 while lying on their back on slant board 56. Bar 58 is then used as an aid for individuals when doing situps or other exercises.

The board 56 may be inclined by connecting one of the bars 20 and 64 to the corresponding ropes 8 and 12 a desired distance above the other bar 20 and 64. Thus, the board 56 may be inclined for performing inclined situps, for example.

Rope 70 has hooks 72 secured to its ends which are attached to ropes 8 via connectors 14. Padded member 74 surrounds a central portion of rope 70. Rope 70 is attached to ropes 8 a desired distance above first end 60. To keep from sliding head first off the slant board 56 when using the board 56 in an inclined position with the feet higher than the head, an individual uses rope 70 to support their neck and shoulders. Thus, an individual's arms and legs are free to perform stretches and exercises without fear of sliding off slant board 56.

Back pad 76 is adjustably secured on an upper surface of slant board 56. Back pad 76 is adjusted along the length of slant board 56 such that when an individual is lying on their back on slant board 56, back pad 76 supports the small of their back. In addition to providing support, back pad 76 allows the individual to do exercises which stretch and strengthen the muscles in their lower back and hips. Slant board 56 also serves as a therapeutic rub down table, etc.

The possibilities for the number of exercises and stretches that are available using the present invention are virtually unlimited, and are bound only by the imagination, strength, and flexibility of the user. The various stretches and exercises that can be performed using the present invention are too numerous to list herein. The previously described exercises are intended only as examples of the numerous exercises available to an individual using the present invention, and are not intended to limit the scope of the present invention or methods of using the same.

The present invention is particularly useful for families since it can be used by persons of any age. Families can use multiple devices so that they can stretch and exercise together. Alternatively, a single device may be quickly and easily adjusted for use by different members of the family.

Its simplicity allows the device to be quickly assembled and disassembled. An individual who travels often can bring the device with them, thereby eliminating the problem of not having exercise equipment available when away from home.

Wherefore, I claim:

1. A method of using a pair of separate exercise devices, said method comprising the steps of:

providing a pair of separate exercise devices with each exercise device comprising:

a coupling member having an attachment mechanism for securing each said coupling member to a desired support member;

a fixed length first elongate flexible member having a first end thereof secured to said coupling member, and a stirrup being secured to a second end of said first elongate flexible member;

a fixed length second elongate flexible member having a first end thereof secured to said coupling member, and a plurality of connectors being spaced along said second elongate flexible member; and at least one body engageable device being attachable to one of said plurality of connectors; and said first and said second elongate flexible members, of each said separate exercise device, both being secured to the same said coupling member so as to be freely movable, relative to one another, along their entire lengths to facilitate a user performing exercises;

suspending said pair of exercise devices from a fixed structure, via said attachment mechanisms, such that said exercise devices are spaced apart from one another a desired distance;

attaching each said body engageable device to a desired one of said plurality of connectors;

engaging the stirrups with the user's feet and grasping said body engageable devices with the user's hand; and performing exercises using said pair of separate exercise devices.

2. A method of using a pair of separate exercise devices according to claim 1 comprising the steps of:

removably attaching ends of a bar to each of said second elongate flexible members via one of said plurality of connectors;

one of placing one's legs over an upper surface of said bar and grasping said bar with one's hands;

hanging one's body from said bar; and performing exercises.

3. A method of using a pair of separate exercise devices according to claim 1 comprising the steps of:

providing a through bore in a first end of a first member, said through bore sized to accommodate a bar;

sliding said bar through said through bore;

attaching said bar with hooks on ends thereof to said elongate flexible members via said connectors;

providing foot members extending outwardly from opposed sides of said first member, parallel to a longitudinal axis of said bar;

providing a second member having knee members extending outwardly from opposed sides of said second member, parallel to said longitudinal axis of said bar;

attaching said second member to said first member;

placing one's legs over an upper surface of said knee members;

hooking one's feet under a lower surface of said foot members;

hanging one's body upside down from said knee members and foot members; and performing exercises.

4. A portable exercise system for suspending from a support member, said exercise system comprising:

a pair of separate exercise devices, and each said separate exercise device comprising:

a rigid coupling member having a ring and an attachment mechanism for securing and suspending each said coupling member to a desired support member in a spaced apart relationship;

a fixed length first elongate flexible member having a first end thereof secured to said ring of said coupling member, and a stirrup being secured to a second end of said first elongate flexible member or engagement with a foot of user;

a fixed length second elongate flexible member having a first end thereof secured to said same ring of said coupling member and having a second free end, and a plurality of separate connectors being successively spaced along said second elongate flexible member; and at least one body engageable device being releasably attached to a desired one of said plurality of connectors, and said body engageable device being engaged, during use, with a hand of a user; and said first and said second elongate flexible members, of each separate exercise device, both being secured to said same coupling member so as to be freely movable, relative to one another, along their entire lengths to facilitate a user performing exercises with said exercise system when the user's feet are supported by said stirrups and the user's hand are supported by said body engageable devices.

5. An exercise system according to claim 4, further comprising:

a safety cord interconnecting said pair of separate exercise devices; and a connector is secured at each end of said safety cord for interconnecting said safety cord with both of said exercise devices.

6. An exercise system according to claim 4, wherein said body engageable device is a bar with hooks, and said hooks are attachable to a desired one of said connectors on each said second elongate flexible member of said pair of exercise devices such that, when said hooks are attached to said connectors, said bar extends between said pair of second elongate flexible members.

7. An exercise system according to claim 6, further comprising an inverted exercise unit which includes:

a first member having a first end and a second end;

a through bore provided in said first member, said through bore being located proximate said first end and sized to receive said bar;

a second member having a first end and a second end, said second member being removably attachable to said first member;

at least one foot member extending outwardly from said inverted exercise unit such that, when said through bore receives said bar, said foot member is oriented substantially parallel to said bar;

at least one knee member extending outwardly from said inverted exercise unit such that, when said through bore receives said bar and said first member is attached to said second member, said knee member is oriented substantially parallel to said bar; and at least one hand bar extending outwardly from said knee member.

8. An exercise system according to claim 7, said first member having an internal cavity sufficiently sized to accommodate a desired length of said second member.

9. An exercise system according to claim 8 comprising:

a plurality of through bores in one of said first and second members;

a single through bore in another of said first and second members;

a pin sufficiently sized to retain said second member within said first member when said second member is inserted a desired distance into said first member, said single through bore is selectively aligned with one of said plurality of through bores, and said pin is inserted through said aligned bores.

10. An exercise system according to claim 4, further comprising:

a body supporting member with a first end which is secured to each of said pair of first elongate flexible members and a second end which is secured to each of said pair of second elongate flexible members; and a padded support adjustably secured to a central portion of said body supporting member.

11. An exercise system according to claim 4, wherein said system further comprises an elongate bar having hook members at opposed ends thereof, said hook member facilitate attaching said elongate bar to a desired one of said plurality of connectors of each said second elongate flexible member to facilitate the user performing exercises.

12. An exercise system according to claim 4, wherein said body engageable device is a hand grip.

13. An exercise system according to claim 4, wherein said plurality of connectors are rings.

14. An exercise system according to claim 4, further comprising at least one hook member which is securable to said body engageable device for removably attaching said body engageable device to one of said connectors.

15. An exercise system according to claim 4, wherein said second elongate flexible member comprises a plurality of elongate flexible member sections connected in series so that one of said plurality of connectors is interposed between adjacent elongate flexible member sections.

16. An exercise system according to claim 4, comprising:

a safety belt;

a pair of loops secured to opposed sides of said belt; and safety straps with first ends secured to each of said loops, respectively, and second ends secured to a fixed structure near at least one support member wherein the safety belt, when worn about a user's waist, prevents the user from falling.

17. An portable exercise system comprising:

a support member comprising an elongate rod and a pair of support legs supporting each opposed end of said elongate rod, and a pair of exercise devices being suspended from said support member;

each said pair of exercise devices comprising:

a rigid coupling member having a ring and a attachment mechanism for securing and suspending each said coupling member of a desired support member in a spaced apart relationship;

a fixed length first elongate flexible member having a first end thereof secure to said ring of said coupling member, and a stirrup being secured to a second end of said first elongate flexible member for engagement with a foot of a user;

a fixed length second elongate flexible member having a first end thereof secured to said same ring of said coupling member and having a second free end, and a plurality separate connectors being successively spaced along said second elongate flexible member; and at least on body engageable device being releasably attached to a desired one of said plurality of connectors, and said body engageable device being engaged, during use, with a hand of a user; and said first and said second elongate flexible members, of each separate exercise device, both being secured to said same coupling member so as to be freely movable, relative to one another, along their entire lengths to facilitate a user performing exercises with said exercise system when the user's feet are supported by said stirrups and the user's hand are supported by said body engageable devices.

* * * * *